US005899157A

United States Patent [19]

Kurono et al.

[11] Patent Number: 5,899,157

[45] Date of Patent: May 4, 1999

[54] PRESSER FOOT DEVICE OF SEWING MACHINE HAVING A PRESSER FOOT ASCENT DETECTION DEVICE AND A CONTROL MECHANISM

[75] Inventors: Yoshikazu Kurono, Aichi-ken; Yasushi Mizuno, Obu; Masaki Shimizu, Toyoake; Yasukazu Noguchi, Nagoya; Hirokazu Hirose, Chiryu, all of Japan

[73] Assignee: Brother Kogyo Kabushiki Kaisha, Nagoya, Japan

[21] Appl. No.: 09/047,343

[22] Filed: Mar. 25, 1998

[30] Foreign Application Priority Data

| | | | |
|---|---|---|---|
| Mar. 25, 1997 | [JP] | Japan | 9-071769 |
| Mar. 25, 1997 | [JP] | Japan | 9-071770 |
| Mar. 28, 1997 | [JP] | Japan | 9-095097 |

[51] Int. Cl.[6] ..... D05B 29/02; D05B 69/28

[52] U.S. Cl. ..... 112/470.01; 112/239; 112/275; 112/284

[58] Field of Search ..... 112/470.01, 237, 112/239, 275, 238, 284

[56] References Cited

U.S. PATENT DOCUMENTS

| | | |
|---|---|---|
| 4,538,533 | 9/1985 | Ohchi et al. . |
| 4,674,424 | 6/1987 | Shiomi et al. . |
| 5,461,997 | 10/1995 | Landén . |

*Primary Examiner*—Peter Nerbun
*Attorney, Agent, or Firm*—Oliff & Berridge, PLC

[57] ABSTRACT

In a presser foot device of a sewing machine, a presser foot is vertically movably supported to a sewing machine body frame by a presser bar. A drive device moves the presser bar up and down in accordance with a drive signal. A sensor detects when the presser foot is raised close to a top dead center position, that is, a predetermined position. Based on the detection by the sensor, a control device controls the drive signal for the presser foot drive device.

31 Claims, 14 Drawing Sheets

PRESSER FOOT DEVICE OF SEWING MACHINE HAVING A PRESSER FOOT ASCENT DETECTION DEVICE AND A CONTROL MECHANISM

BACKGROUND OF THE INVENTION

1. Field of the Invention

The invention relates to a presser foot device of a sewing machine capable of moving a presser foot up and down by automatic operation.

2. Description of the Related Art

Conventional sewing machines equipped with a presser foot for pressing a work cloth onto a bed employ various manual operating levers for moving the presser foot up and down. For example, an ordinary presser foot device employed in pattern sewing machines, that include embroidering machines, has a presser foot vertically movably connected to a body frame by a presser bar, an operating lever for switching the presser foot between an ascent position and a descent position, and a spring member urging the presser foot in the descending direction. During sewing, the presser foot is reciprocated within a small stroke at the descent position in accordance with cloth feeding actions. The presser foot is switched to the ascent position by manually operating the operating lever, for example, for replacement of a cloth holding frame that holds a work cloth to be sewed, or for checking the sewing start position in the work cloth held by the cloth holding frame, or at the time of a thread breakage. To start or restart sewing, the presser foot is switched to the descent position by manually operating the operating lever. Beside such manual presser foot devices, an automatic presser foot device has been developed for commercial use, which automatically moves a presser foot up and down by driving an actuator, such as a rotary solenoid or the like, in accordance with switch operations performed on various switches, such as externally provided push button switches.

However, it is difficult or impossible to freely adjust the amount of motion of actuators, such as solenoids. Therefore, to determine the position to which the presser foot is to be shifted, particularly, the position at the time of ascent, a structure having a member, integrated with the presser foot, is caused to impact an arm or the like, whereby the presser foot is stopped at a desired ascent position. However, impact noises are produced when the presser foot is raised, thus giving rise to noise problems. This structure also suffers from the high cost of solenoid actuators.

SUMMARY OF THE INVENTION

Accordingly, it is an object of the invention to provide a presser foot device of a sewing machine capable of shifting a presser foot to a desired position without producing noise and capable of determining, in a favorable manner, whether the presser foot has been raised to a predetermined position even when the fixing position of the presser foot to a press bar has been adjusted. More particularly, an object of the invention is to prevent interference between an operating lever and a stepping motor and to prevent deterioration of the feeling of manual operation of an operating lever.

According to one aspect of the invention, there is provided a presser foot device of a sewing machine including a presser foot vertically movably supported to a sewing machine body frame by a presser bar, and a drive device that moves the presser bar up and down in accordance with a drive signal. A detection device detects an ascent of the presser foot to a predetermined position. A control device controls the drive signal on the basis of the result of the detection made by the detection device.

With this structure, the invention makes it possible to freely define the shift position of the presser foot by adjusting the detection signal. The detection device detects ascent of the presser foot to the predetermined position. Based on the result of the detection, the control device controls the drive signal. Therefore, the presser foot device of the invention is able to precisely control the drive signal in accordance with the actual position of the presser foot. The presser foot device does not need a mechanical impact in order to define the shift position of the presser foot, but is able to shift the presser foot to a desired position without producing noise. Thus, the presser foot device allows noise reductions of the sewing machine.

According to the invention, the drive device may include a stepping motor. Stepping motors are easy to produce, inexpensive, small in size, and produce less noise. Therefore, use of a stepping motor advantageously allows further reductions in the cost, size and noise level of the sewing machine.

According to another aspect of the invention, there is provided a presser foot device of a sewing machine including a presser foot that presses a work cloth against a bed, a drive device that continually moves the presser foot up and down in accordance with a drive signal using a drive force transmitting mechanism, and an operating lever that abuts on a portion of the presser foot. The operating lever moves in accordance with vertical movements of the presser foot while abutting thereon. A detection device detects an ascent of the presser foot to a predetermined position on the basis of a shift in position of the operating lever.

With this structure, the operating lever abuts on a portion of the presser foot and moves in accordance with upward and downward movements of the presser foot. The detection device detects an ascent of the presser foot to the predetermined position on the basis of a shift of the operating lever in position. Since the operating lever abuts on a portion of the presser foot and moves abutting thereon, the actual position of the presser foot is favorably reflected in the shift in position of the operating lever. Because the detection device detects ascent of the presser foot to the predetermined position on the basis of the shift of the operating lever in position, the ascent of the presser foot to the predetermined position can be precisely detected. For example, even in a case where the fixing position of the presser foot to the presser bar has been adjusted, the ascent of the presser foot to the predetermined position can be precisely detected.

The drive device may include a stepping motor, and a control device may be further provided for controlling the stepping motor on the basis of the result of the detection made by the detection device. As the stepping motor, constituting the drive device, is controlled on the basis of the result of the detection made by the detection device, this structure makes it possible to move the presser foot to a desired position without using a mechanical impact. Therefore, the structure prevents noise production. Moreover, because the detection device is able to precisely detect the actual position of the presser foot as described above, this structure is also capable of reliably moving the presser foot to a desired position, in addition to preventing mechanical impacts in a preferable manner and preventing noise production. Therefore, the structure advantageously allows a further noise reduction and a further reliability improvement in the sewing machine.

The operating lever may be designed to separate from the presser foot during descent of the presser foot and to abut on a portion of the presser foot when the presser foot is raised close to the predetermined position. As the presser foot separates from the operating lever during descent of the presser foot, it becomes easy to perform various operations in connection with the presser foot or the surrounding structures, such as adjustment of the fixing position of the presser foot to the presser bar, or the like. Furthermore, because the operating lever abuts on a portion of the presser foot when the presser foot rises close to the predetermined position, ascent of the presser foot to the predetermined position can be detected in a preferable manner as stated above. Therefore, this structure of the invention further improves the operability of the sewing machine in various operations in relation to the presser foot and the surrounding structures.

The drive device may include a spring member that engages with and urges the drive force transmitting mechanism to restrict the turning of the drive force transmitting mechanism. When the operating lever, constituting the drive force transmitting device, is turned or pivoted, the spring member turns over, thereby restricting excessive turning of the operating lever and facilitating control of the stepping motor.

According to still another aspect of the invention, there is provided a presser foot device of a sewing machine including a presser foot vertically movably supported to a sewing machine body frame by a presser bar, an operating lever for switching the presser foot between an ascent position and a descent position, a spring member that urges the presser foot in the descending direction, a detection device that detects the presence of the presser foot at the ascent position using one of the presser foot and the operating lever, and a stepping motor operatively connected to the presser foot. The stepping motor is capable of at least driving the presser foot upward. A control device receives a detection signal from the detection device, and controls the stepping motor so as to allow the presser foot to be lowered by manually operating the operating lever. The control device may also allow ascent of the presser foot in addition to the descent thereof.

The detection device detects the presence of the presser foot at the ascent position using the presser foot or the operating lever. The stepping motor is operatively connected to the presser foot and is able to at least drive the presser foot upward. The control device receives the detection signal from the detection device, controls the stepping motor in accordance with an ascent or descent instruction from an external device, and controls the stepping motor so as to allow the presser foot to be raised or lowered by manually operating the operating lever. Therefore, upon receiving an ascent instruction from an external device, the control device raises the presser foot by driving the stepping motor. Upon receiving a descent instruction from an external device, the control device lowers the presser foot by, for example, discontinuing magnetizing the stepping motor. The presser foot can also be raised and lowered through manual operation without causing interference between the presser foot and the stepping motor.

The stepping motor may be operatively connected to the presser foot by the operating lever. This structure makes it possible for the stepping motor to raise and lower the presser foot to the ascent and descent positions using the operating lever.

The presser foot device may further include a spring member that presses and urges the operating lever in accordance with the operation position of the operating lever. Thereby, the operating lever is urged by the spring member in accordance with the operation position of the operating lever, noise production can be substantially prevented even when the operating lever vibrates.

When the control device raises the presser foot from the descent position by operating the stepping motor in response to an ascent instruction, the control device may detect a magnetization phase of the stepping motor at the time of detection of the ascent position of the presser foot by the detection device, and may store the magnetization phase into a memory as a detected magnetization phase. In this structure, when the control device raises the presser foot from the descent position by operating the stepping motor in response to an ascent instruction, the control device detects a magnetization phase of the stepping motor at the time of detection of the ascent position of the presser foot by the detection device, and stores the magnetization phase into a memory as a detected magnetization phase. Therefore, both when the presser foot is raised by manual operation and when the presser foot is automatically raised in response to an ascent instruction, it is possible to smoothly stop the presser foot at the same ascent position using the detected magnetization phase stored in the memory. Further, the magnetization phase of the stepping motor is detected, stored and thereby updated every time the presser foot is raised by the stepping motor. Therefore, a magnetization phase of the stepping motor optimal to the ascent position of the presser foot can be detected and stored even in a case where the detected magnetization phase deviates due to mechanical abrasion in the presser foot device.

When the presser foot is at the ascent position, the control device may keep the stepping motor in a magnetized state in which the stepping motor is in a predetermined magnetization phase that is advanced from the detected magnetization phase by a predetermined number of steps. That is, when the presser foot is at the ascent position, the control device maintains a magnetization phase of the stepping motor that is advanced from the detected magnetization phase by the predetermined number of steps. Therefore, it is possible to reliably detect the ascent position of the presser foot using the detection device even in a case where vibrations occur due to sewing. Further, as the stepping motor is kept in the magnetized state of the predetermined magnetization phase when the presser foot is at the ascent position, it is possible to hold the presser foot at the ascent position although the presser foot is urged downward by the spring member.

When the operating lever is manually operated to lower the presser foot from the ascent position, the control device may discontinue magnetizing the stepping motor so as to allow the presser foot to descend. The control device may maintain the discontinuation of magnetization while the presser foot remains at the descent position. Because the presser foot is urged downward by the spring member, the presser foot descends to the descent position due to the elastic force of the spring member when magnetization of the stepping motor is discontinued. Since the discontinuation of magnetization of the stepping motor is maintained while the presser foot is at the descent position, the presser foot device is able to perform sewing by driving the presser foot up and down using a separate drive system, synchronously with a sewing machine motor.

When the presser foot is raised from the descent position by manually operating the operating lever, the control device may magnetize and keep the stepping motor in the predetermined magnetization phase that is first detected after the ascent position of the presser foot is detected by the detection device. Thereby, when the presser foot is manually raised and stopped at the ascent position, an approximately ½ step rotation of the presser foot motor 154 in the forward or the backward direction is prevented and, therefore, no disagreeable operating feeling is given to an operator's hand, thereby improving operating feeling.

When the control device lowers the presser foot from the ascent position in response to a descent instruction, the control device may discontinue magnetizing the stepping motor. The control device may maintain the discontinuation of magnetization while the presser foot remains at the descent position. Because the presser foot is urged downward by the spring member, the presser foot descends to the descent position when magnetization of the stepping motor is discontinued. Also, the discontinuation of magnetization of the stepping motor is maintained while the presser foot is at the descent position. Thus, the presser foot device is able to perform sewing by driving the presser foot up and down using a separate drive system, synchronously with a sewing machine motor.

When the control device raises the presser foot from the descent position in response to an ascent instruction, the control device may magnetize and keep the stepping motor in the predetermined magnetization phase that is first detected after the ascent position of the presser foot is detected by the detection device. Thereby, it becomes possible to stop and hold the presser foot at the same ascent position both when the presser foot is manually raised and when the presser foot is automatically raised in response to an ascent instruction.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Preferred embodiments of the invention will be described in detail hereinafter with reference to the accompanying drawings.

Figure 1:
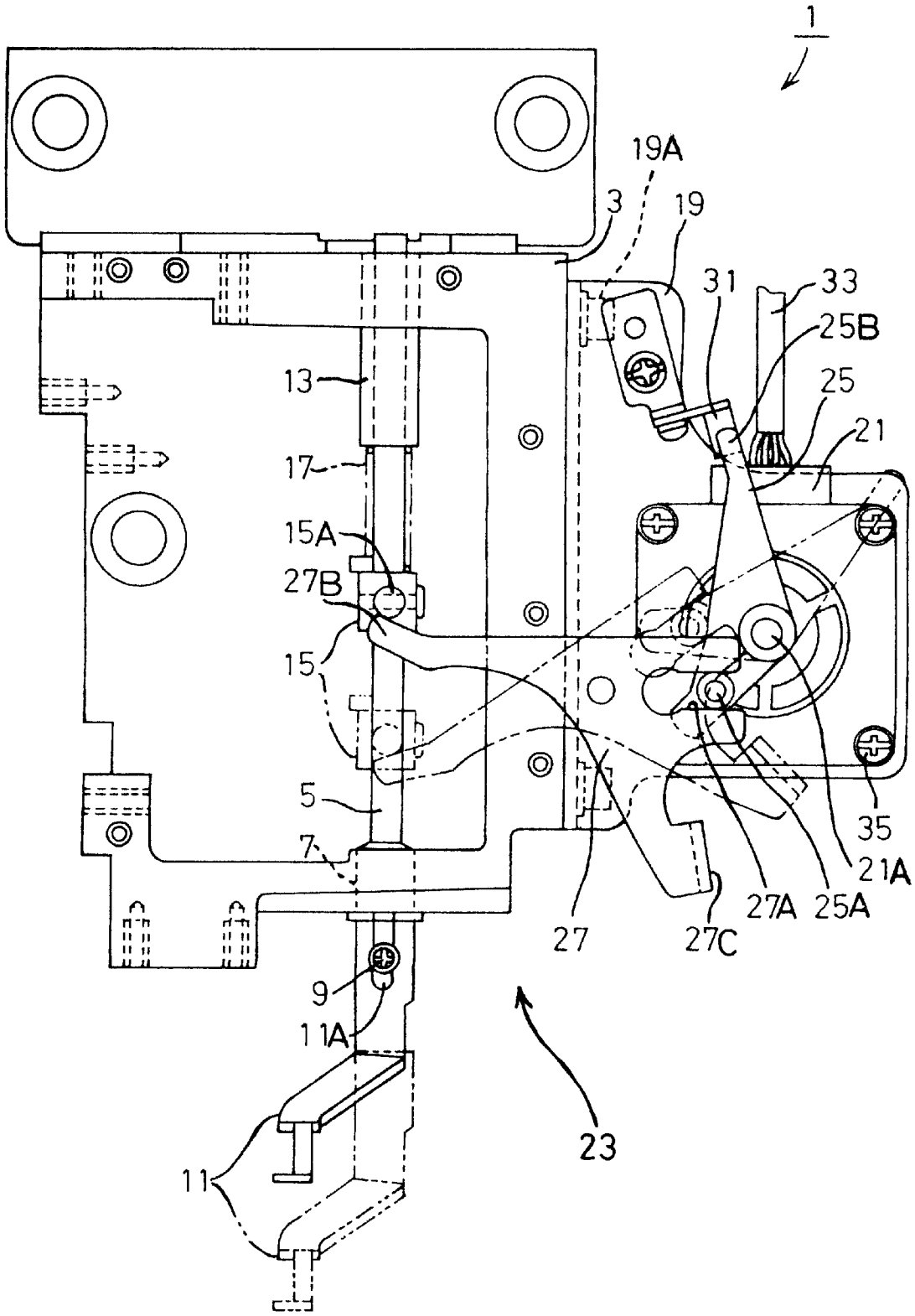
FIG. 1 is a front elevation of a first preferred embodiment of the presser foot device of the invention.

FIG. 1 is a partial front view of a sewing machine 1 having a presser foot device 23 according to a first preferred embodiment of the invention, wherein a face place (not shown) of an arm 3 is removed.

In the presser foot device 23, a presser bar 5 is disposed in a lower portion of the arm 3 so that the presser bar 5 is slidable up and down through a sleeve 7. A presser foot 11 is fixed to a lower end of the presser bar 5 by a screw 9. The presser foot 11 has a vertically elongated hole 11A into which the screw 9 is insertable. The vertical position at which the presser foot 11 is fixed to the presser bar 5 can be adjusted based on the insert position of the screw 9 in the elongated hole 11A of the presser foot 11. A pressure adjusting screw 13 is screwed to an upper portion of the arm 3. A pressing spring 17 is disposed in a compressed state between a lower end of the pressure adjusting screw 13 and an upper end of a holder 15 fixed to an intermediate portion of the presser bar 5.

A support plate 19 is fixed onto a side surface of the arm 3 by screws 19A. The support plate 19 carries thereon a stepping motor 21. The stepping motor 21 is able to produce rotation of a desired angle corresponding to a drive signal inputted through a signal line 33. The stepping motor 21 is fixed to the support plate 19 by screws 35 in a posture in which a rotating shaft 21A of the stepping motor 21 extends parallel to the face plate (perpendicular to the sheet of the drawing of FIG. 1). A lever 25 is fixed at its approximately central portion to the rotating shaft 21A. An end portion of the lever 25 has a protrusion 25A that engages with a cutout 27A formed in a link 27. The link 27 is oscillatably connected at its approximately central portion to the support plate 19. An end 27B of the link 27, opposite to the cutout 27A, abuts, from below, on a protrusion 15A projected from the holder 15. An operating portion 27C extends perpendicularly from a lower portion of the link 27. By pushing the operating portion 27C, the link 27 can also be oscillated. A sensor portion 31 has a well-known Hall element or the like. The sensor portion 31 detects proximity of a second end 25B of the lever 25 when the presser bar 5 is raised close to a top dead center as indicated by solid lines in FIG. 1.

Figure 2:
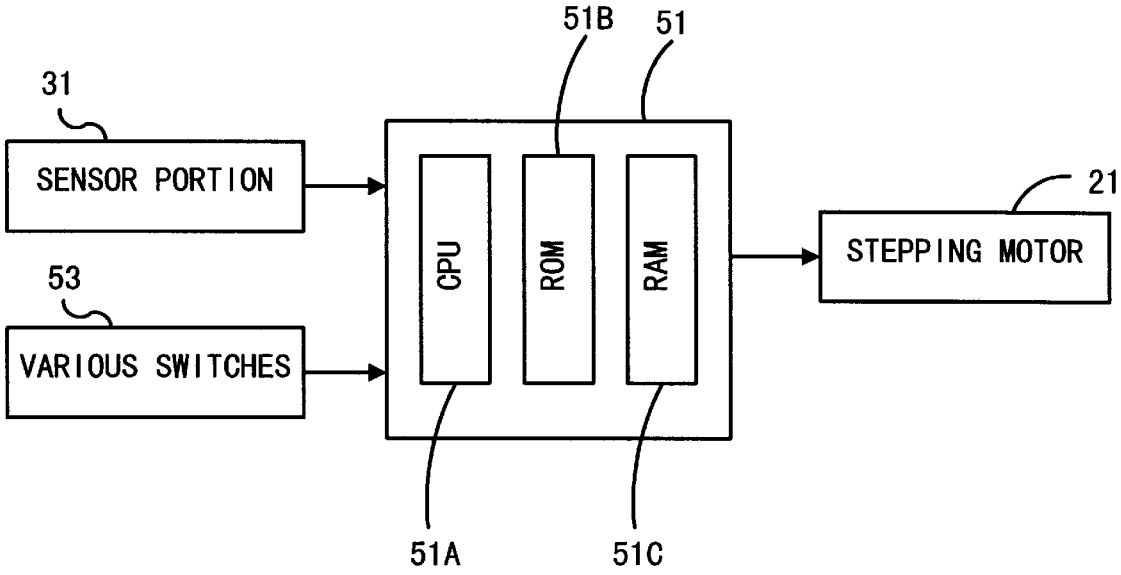
FIG. 2 is a block diagram illustrating the structure of a presser foot device control system according to the first embodiment.

The operation of the presser foot device 23 will next be described. Referring to FIG. 2, the sensor portion 31 outputs a detection signal to an electronic control circuit 51. The electronic control circuit 51 is formed of a known microcomputer mainly composed of a CPU 51A, a ROM 51B and a RAM 51C. The electronic control circuit 51 reads the detection signal from the sensor portion 31 and the operation states of various switches 53, such as an externally-disposed push button switch, and outputs a drive signal to the stepping motor 21 as described below.

Normally, the presser foot 11 is lowered and held at a lower position by the elastic force of the pressing spring 17, as indicated by two-dot lines in FIG. 1. Correspondingly, the lever 25 is held at a clockwise moved position as indicated by two-dot lines in FIG. 1. When the various switches 53 are operated to raise the presser foot 11, the electronic control circuit 51 correspondingly operates the stepping motor 21 in the counterclockwise direction in FIG. 1. Rotation is transmitted from the stepping motor 21 to the holder 15 by the lever 25 and the link 27, thereby raising the presser foot 11. Upon the detection signal from the sensor portion 31 indicating proximity of the second end 25B, the electronic control circuit 51 further rotates the stepping motor 21 counterclockwise an amount corresponding to a predetermined number of pulses, and then stops the stepping motor 21. The presser foot 11 is thereby raised and stopped close to the top dead center as indicated by solid lines in FIG. 1.

When the various switches 53 are operated to lower the presser foot 11, the electronic control circuit 51 drives the stepping motor 21 an amount corresponding to a predetermined number of pulses in the clockwise direction in FIG. 1. The number of pulses is pre-set to a value that is sufficient to cause the presser foot 11 to descend completely. When the drive control is completed, the presser foot 11 is pressed against a work cloth laid on a bed (not shown), by a force corresponding to the elastic force of the pressing spring 17.

As described above, the presser foot device 23 moves the presser foot 11 up and down in accordance with rotation of the stepping motor 21, so that the presser foot 11 can be stopped at a desired position by adjusting the drive signal to the stepping motor 21. Therefore, the presser foot device 23 does not need a mechanical abutment in order to define the stop position of the presser foot 11. That is, the presser foot device 23 is able to move the presser foot 11 to a desired position without producing noise. Furthermore, ascent of the presser foot 11 close to the top dead center is detected using the sensor portion 31, and the stepping motor 21 is controlled on the basis of the detection signal from the sensor portion 31. Therefore, the presser foot device 23 of this embodiment is able to stop the presser foot 11 precisely at an optimum ascent position (for example, a position slightly before the presser foot 11 strikes the lower end of the arm 3).

The stepping motor 21 is easy to control, inexpensive, and small in size, and does not produce much noise. Therefore, this embodiment allows reductions in the cost, size and noise of the sewing machine 1. Further, the presser foot 11 can be moved up and down by the link 27 abutting on the protrusion 15A of the holder 15 from below in this embodiment. Additionally, the presser foot 11 itself can easily be manually pushed up without touching the link 27 so it is not turned upward or downward. Subsequent manual lowering of the presser foot 11 therefore does not affect the stepping motor 21. The presser foot 11 readily returns to the original position when the presser foot 11 is released from the operator's hand. Therefore, the operability of the sewing machine 1 further improves, and the control of the stepping motor 21 is further facilitated.

In this embodiment, the stepping motor 21, the lever 25 and the link 27 constitute a drive device, the sensor portion 31 constitutes a detection device, and the electronic control circuit 51 constitutes a control device. The invention is not limited to this embodiment in any manner, but may be modified in various ways without departing from the scope of the invention.

For example, although, in the foregoing embodiment, the stepping motor 21 is operated in accordance with the operations performed on the various switches 53 to move the presser foot 11 up and down, it is also possible to automatically move the presser foot 11 up and down by operating the stepping motor 21 in accordance with execution of a sewing program.

Furthermore, the drive device may employ various structures other than the mechanism having the link 27. For example, a mechanism using meshing between a rack and a pinion may be employed. Further, instead of the stepping motor 21, various driving units, such as an AC motor, a DC motor and the like, may be used.

Figure 3:
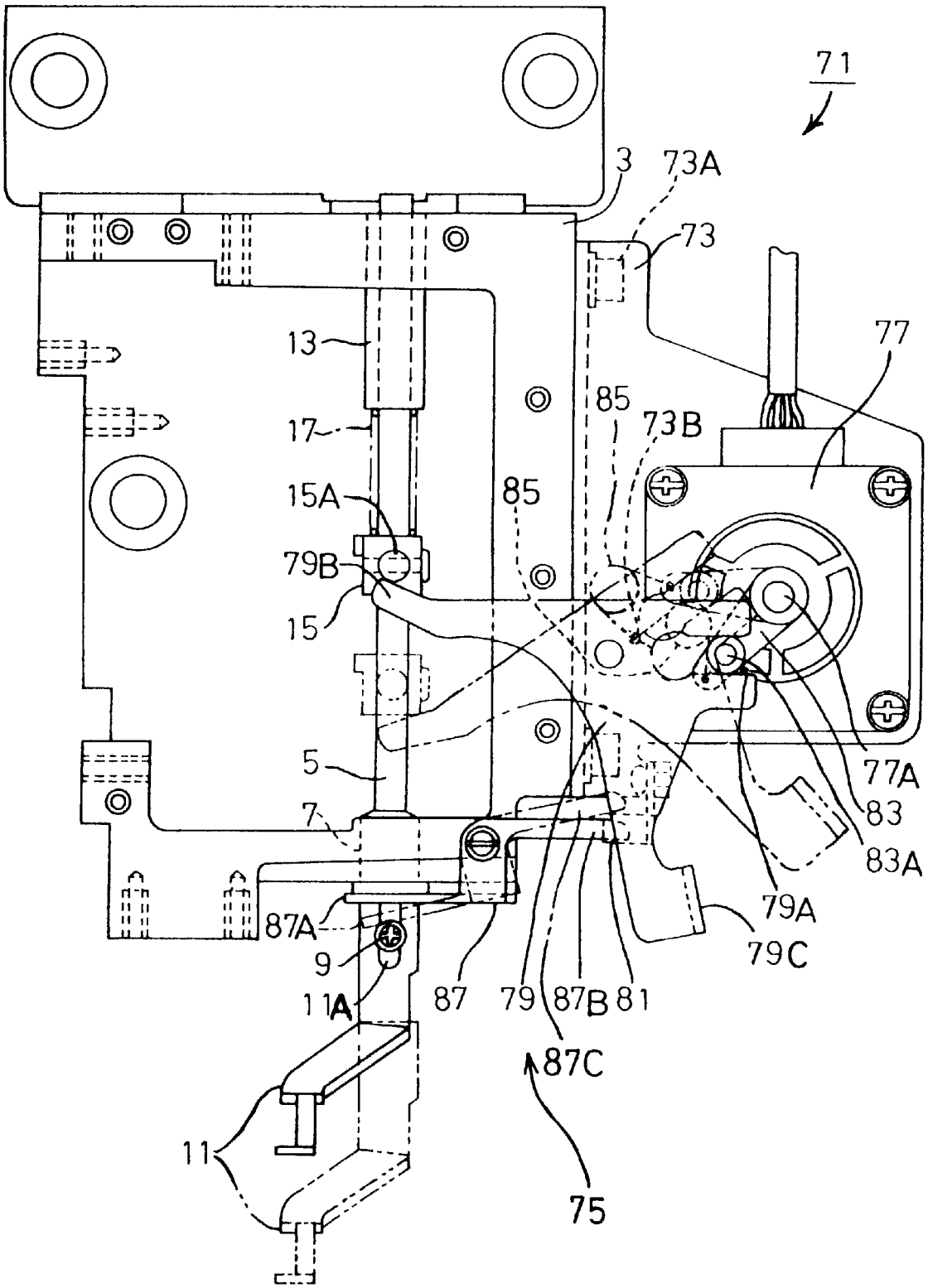
FIG. 3 is a front elevation of a second preferred embodiment of the presser foot device of the invention.

FIG. 3 is an elevation of a second embodiment of the invention. In a sewing machine 71 according to the second embodiment, the structure including the interior of an arm 3 and a presser foot 11 is substantially the same as that in the sewing machine 1 of the first embodiment. The portions of the structure comparable to those in the first embodiment are represented in FIG. 3 by the same reference numerals as used in FIG. 1, and will not be described again. A support plate 73 is mounted onto a side surface of the arm 3 by screws 73A. The support plate 73 carries a stepping motor 77 fixed thereto, with a rotating shaft 77A of the stepping motor 77 extending parallel to the face plate. A link 79 is oscillatably connected to the support plate 73. A sensor portion 81 is provided at a lower end of the support plate 73. A lever 83 is fixed at an end thereof to the rotating shaft 77A of the stepping motor 77. A second end of the lever 83 has a protrusion 83A that engages with a cutout 79A formed in the link 79. An end 79B of the link 79 opposite to the cutout 79A abuts, from below, on the protrusion 15A projected from the holder 15 fixed to the presser bar 5. An operating portion 79C extends perpendicularly from a lower portion of the link 79. The link 79 can be oscillated by pressing the operating portion 79C with a finger.

The second end of the lever 83 engages with an end of a torsion coil spring 85. The other end of the torsion coil spring 85 is engaged with a hole 73B formed in the support plate 73. When the lever 83 is oscillated, the torsion coil spring 85 turns over. The torsion coil spring 85 restricts excessive oscillation of the lever 83, and thereby facilitates control of the stepping motor 77. The torsion coil spring 85 also prevents the protrusion 83A from disengaging from the cutout 79A.

An operating lever 87 is oscillatably disposed at a lower end of the arm 3. The operating lever 87 is such that when the presser foot 11 rises close to the top dead center, an end portion 87*a* of the operating lever 87 abuts on an upper end of the presser foot 11. After that, the operating lever 87 turns clockwise, shown in FIG. 3, as the presser foot 11 further rises. The sensor portion 81 has a known Hall element or the like, and detects the proximity of a second end portion 87B of the operating lever 87 when the operating lever 87 turns close to a position indicated by a solid line in FIG. 3. During descent of the presser foot 11, the operating lever 87 turns counterclockwise, shown in FIG. 3, due to its weight balance. The turning of the operating lever 87 stops when a bent portion 87C of the operating lever 87 from which the end portion 87B substantially horizontally extends contacts a lower end of the arm 3 (that is, when the operating lever 87 turns to a position indicated by a two-dot line in FIG. 3). As the presser foot 11 further descends, the presser foot 11 separates from the end portion 87A.

Figure 4:
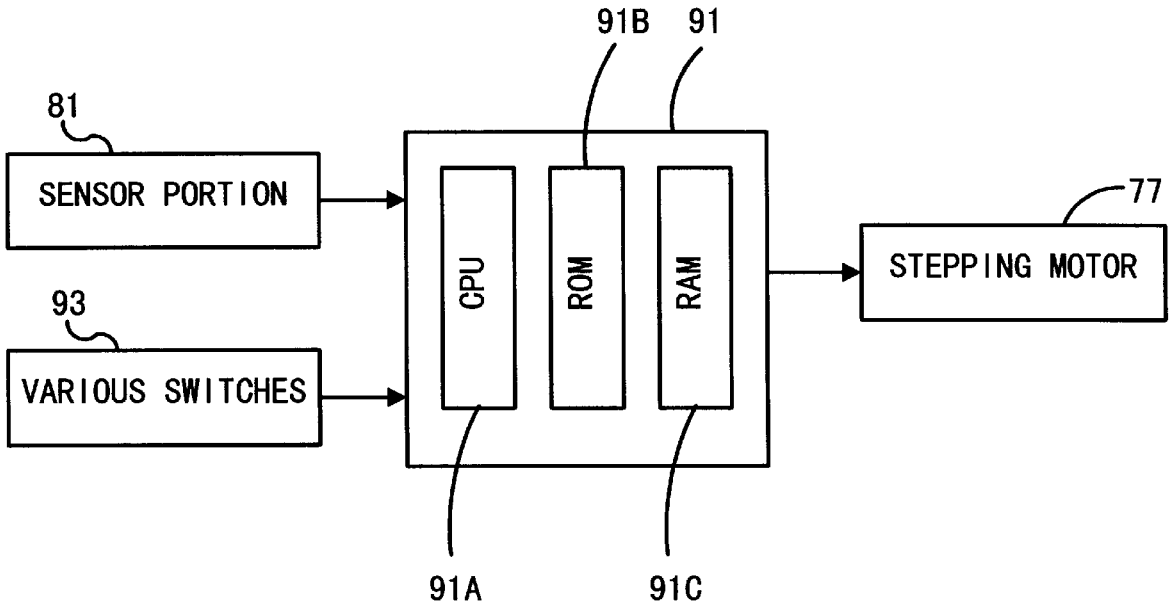
FIG. 4 is a block diagram illustrating the structure of a presser foot device control system according to the second embodiment.

The operation of the presser foot device 75 will be described. Referring to FIG. 4, the sensor portion 81 outputs a detection signal to an electronic control circuit 91. The electronic control circuit 91 is formed of a known microcomputer mainly composed of a CPU 91A, a ROM 911B and a RAM 91C. The electronic control circuit 91 reads the detection signal from the sensor portion 81 and the operation states of various switches 93, such as an externally-disposed push button switch, and outputs a drive signal to the stepping motor 77 as described below.

Normally, the presser foot 11 is lowered and held at a lower position by the elastic force of the pressing spring 17, as indicated by two-dot lines in FIG. 3. Correspondingly, the lever 83 is held at a clockwise moved position as indicated by two-dot lines in FIG. 3. When the various switches 93 are operated to raise the presser foot 11, the electronic control circuit 91 correspondingly operates the stepping motor 77 in the counterclockwise direction in FIG. 3. Rotation is transmitted from the stepping motor 77 to the holder 15 by the lever 83 and the link 79, thereby raising the presser foot 11.

The upper portion of presser foot 11 further rises and contacts the first end portion 87A of the operating lever 87. When the sensor portion 81 detects proximity of the second end portion 87B of the operating lever 87, the electronic control circuit 91 further rotates the stepping motor 77 counterclockwise an amount corresponding to a predetermined number of pulses, and then stops the stepping motor 77. The presser foot 11 is thereby raised and stopped close to the top dead center as indicated by solid lines in FIG. 3. When the various switches 93 are operated to lower the presser foot 11, the electronic control circuit 91 drives the stepping motor 77 an amount corresponding to a predetermined number of pulses in the clockwise direction in FIG. 3. The number of pulses is pre-set to a value that is sufficient to cause the presser foot 11 to descend all the way down. When this drive control is completed, the presser foot 11 is pressed against a work cloth laid on a bed (not shown), by a force corresponding to the elastic force of the pressing spring 17.

As described above, the presser foot device 75, according to the second embodiment, moves the presser foot 11 up and down in accordance with rotation of the stepping motor 77, so that the presser foot 11 can be stopped at a desired position by adjusting the drive signal to the stepping motor 77. Therefore, the presser foot device 75 does not need a mechanical abutment in order to define the stop position of the presser foot 11. That is, the presser foot device 75 is able to move the presser foot 11 to a desired position without producing noise. Furthermore, ascent of the presser foot 11 close to the top dead center is detected using the sensor portion 81, and the stepping motor 77 is controlled on the basis of the detection signal from the sensor portion 81. Therefore, the presser foot device 75 of this embodiment is able to stop the presser foot 11 precisely at an optimum ascent position (for example, a position slightly before the presser foot 11 strikes the lower end of the arm 3).

In the presser foot device 75 of the second embodiment, the first end portion 87A of the operating lever 87 directly contacts an upper portion of the presser foot 11, so that the actual position of the presser foot 11 is appropriately reflected in the oscillation of the operating lever 87. Therefore, it is possible to precisely detect the ascent of the presser foot 11 close to the top dead center even when the fixing position of the presser foot 11 to the presser bar 5 is adjusted using a screw 9. Consequently, the presser foot device 75 is able to stop the presser foot 11 precisely at an appropriate ascent position, thereby achieving noise reductions and providing for improvements in the reliability of the sewing machine 71. Moreover, in the presser foot device 75, the presser foot 11 separates from the operating lever 87 as the presser foot 11 descends, so that it becomes easy to perform various operations in connection with the presser foot 11 or the surrounding structures, such as adjustment of the fixing position of the presser foot 11 to the presser bar 5, and the like. Therefore, the operability of the sewing machine 71 can be further improved.

In the second embodiment, the stepping motor 77, the lever 83 and the link 79 constitute a drive device, the lever 83 and the link 79 constitute a drive force transmitting device, the sensor portion 81 constitutes a detection device, and the electronic control circuit 91 constitutes a control device. The invention is not limited by the second embodiment, but may be modified in various ways without departing from the scope of the invention. For example, it is possible to employ a lever that continuously presses the presser foot 11 all the way down to the bottom dead center or a lever that translates vertically in accordance with vertical movements of the presser foot 11. If a lever that continuously presses the presser foot 11 all the way down to the bottom dead center is used, it is also possible to use a detection device capable of continuously detecting the movement of the lever. Such a structure makes it possible to continuously and precisely detect the movement of the presser foot 11.

Although, in the second embodiment, the stepping motor 77 is operated in accordance with the operations performed on the various switches 93 to move the presser foot 11 up and down, it is also possible to automatically move the presser foot 11 up and down by operating the stepping motor 77 in accordance with the execution of a sewing program.

Further, it is possible to use the ascent state of the presser foot 11, detected by the detection device (sensor portion 81), for a purpose other than the control of the stepping motor 77. For example, if the sewing machine 71 has a holding frame for moving a work cloth on a horizontal plane, as in a pocket setter or an embroidering machine, it is possible to allow a movement of the holding frame after confirming that the presser foot 11 has been raised. Such a control operation may be performed by using the detection signal from the sensor portion 81. Further, it is also possible to apply the invention even to a structure wherein the sewing machine moves the presser foot 11 up and down using a solenoid or the like. In other words, it is possible to use various devices, such as a solenoid or the like, as a drive device, according to the invention.

A third embodiment of the invention is applied to a multi-head embroidering machine having three embroidering machines.

Figure 5:
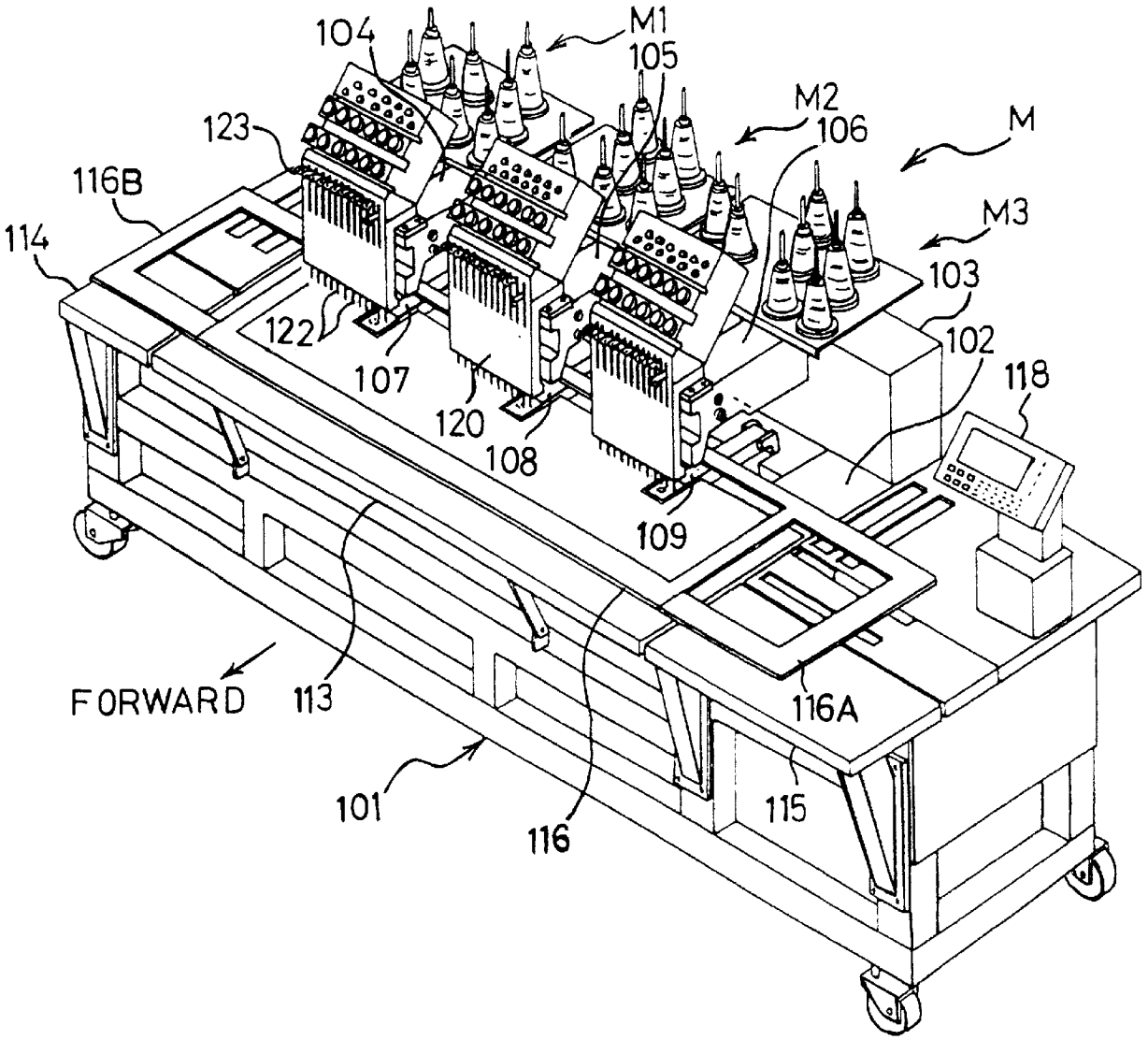
FIG. 5 is a perspective view of a multi-head embroidering machine.

A multi-head embroidering machine M according to the third embodiment will be described with reference to FIG. 5. A machine supporting plate 102 is disposed on a rearward portion of an upper surface of a base frame 101 that extends in the right-left direction (as shown in FIG. 5). The machine supporting plate 102 has a generally rectangular shape (in a plan view) with a predetermined dimension in the right-left direction. Provided on a rear end portion of the machine supporting plate 102 is a support frame 103 extending in the right-left direction. The support frame 103 carries thereon three head units 104–106 aligned in the right-left direction with a predetermined space left therebetween. A portion of the base frame 101 positioned corresponding to a front end portion of the machine supporting plate 102 supports rear end portions of cylinder-like bed units 107–109 that are aligned corresponding to the head units 104–106. Thus, three multi-needle embroidering machines M1–M3 formed of the head units 104–106 and the bed units 107–109 are disposed side by side.

Each of front end portions of the head units 104–106 of the embroidering machines M1–M3 supports a needle bar case 120 that is movable in the right-left direction. The needle bar case 120 vertically movably supports twelve needle bars 121 (see FIG. 6) arranged in a line in the right-left direction, and supports twelve yokes 123 oscillatably. The needle bar cases 120 are moved altogether in the right-left direction by a needle bar replacing mechanism (not shown) driven by a needle bar replacing motor 179 (see FIG. 9), to allow simultaneous replacement of all the needle threads with threads of different colors.

Each of the bed units 107–109 is provided with a rotating hook for capturing a thread loop of the needle thread of a sewing needle 122 (described below) in timing with the vertical movements of the sewing needle 122, and a thread cutting mechanism (not shown) for cutting needle and bobbin threads.

A working table 113 extends horizontally forward of the machine supporting plate 102, with the top surface of the working table 113 being flush with the top surfaces of the bed units 107–109. A movable frame 116 having a generally rectangular shape in a plan view extends in the right-left direction over the working table 113 and a pair of auxiliary tables 114,115 provided on the right and left sides of the working table 113.

The movable frame 116 is driven at a drive frame portion 116A provided at a right end of the movable frame 116, in the direction of an X axis (right-left direction) by an X-axis driving mechanism (not shown). The movable frame 116 is also driven in the direction of a Y axis (front-rear direction) by a Y-axis driving mechanism (not shown), at the drive from portion 116A and another drive frame portion 116B provided at a left end of the movable frame 116.

Figure 9:
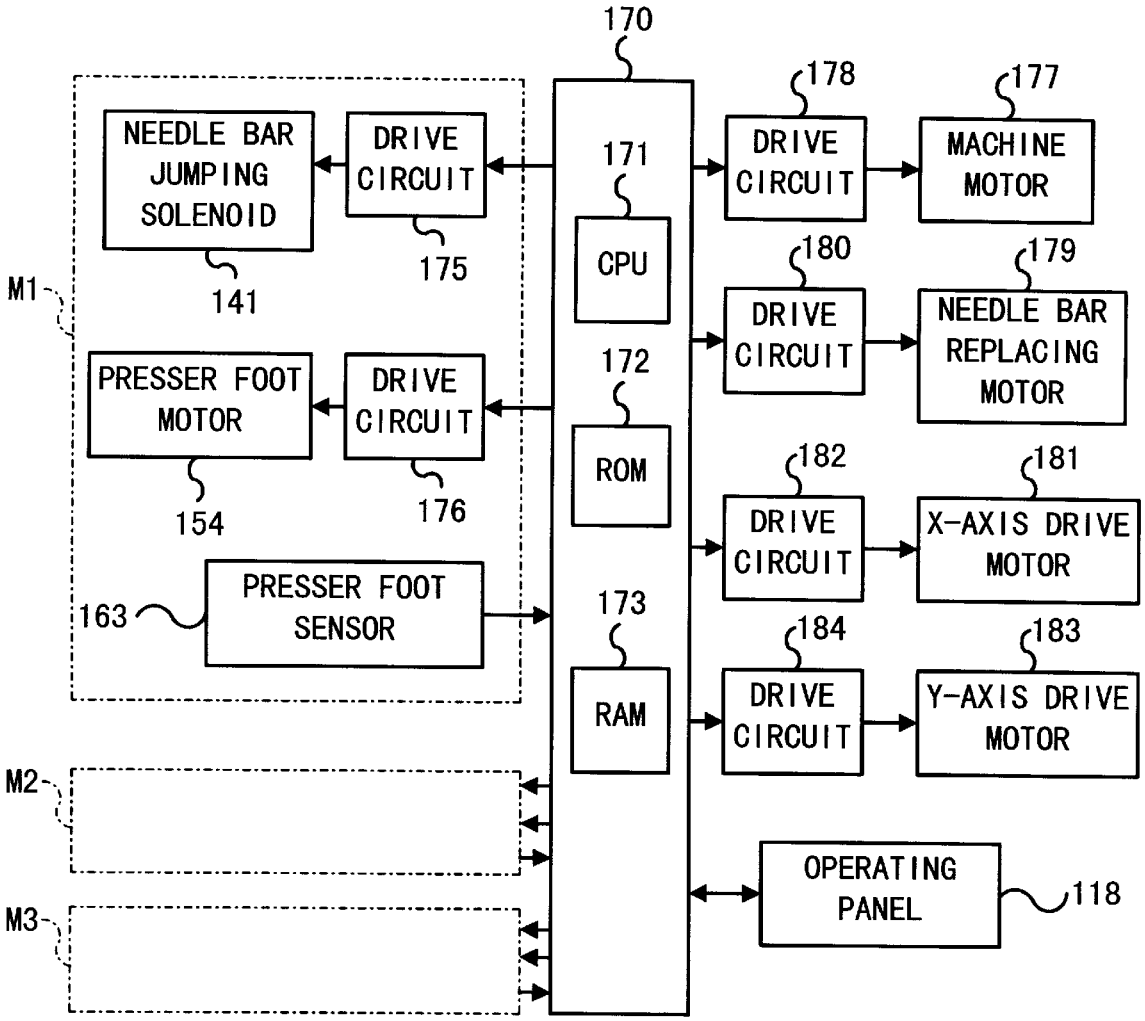
FIG. 9 is a block diagram of a control system of a multi-head embroidering machine.

The movable frame 116 can thus be moved on the X-Y plane by the X-axis driving mechanism driven by an X-axis driving motor 181 (see FIG. 9) and the Y-axis driving mechanism driven by a Y-axis driving motor 183 (see FIG. 9). An operating panel 118 is provided rearward of the auxiliary table 115. The operating panel 118 has a display for displaying messages regarding embroidery, various function switches and the like.

A needle bar driving mechanism 125 is provided for each of the embroidering machines M1–M3 to drive the needles 121 up and down and will be briefly described with reference to FIG. 6.

A vertically extending base needle bar 126 is disposed at a distal end portion of each of the head units 104–106. The base needle bars 126 are supported at their upper and lower ends by a body frame. Each base needle bar 126 is fitted into a vertically movable member 127 that has an engaging groove 127A for engagement with a connecting pin 134 described below. A needle bar holder 128, provided at a lower end of each vertically movable member 127, is fitted over the corresponding base needle bar 126 in such a manner that the needle bar holder 128 is vertically movable but prevented from rotating. Each needle bar holder 128 is connected to the lower end of the corresponding vertically movable member 127 in such a manner that the vertically movable member 127 is rotatable. Each needle bar holder 128 is connected to a link 131 which is connected to an oscillating lever 130 that is oscillatably pivoted to a pivot shaft 129.

A main shaft 117 extends through the head units 104–106 in the right-left direction. Eccentric cams 132 are fixed to the main shaft 117. Each eccentric cam 132 is fitted into an eccentric lever 133 whose lower end is connected to the corresponding oscillating lever 130.

Each of the 12 needle bars 121 of each head unit holds, at its lower end, a sewing needle 122. A connecting pin 134 is fixed to a vertically intermediate portion of each needle bar 121. A compressed coil spring 135 is disposed around each needle bar 121, between its connecting pin 134 and the frame of the needle bar case 120. The needle bars 121 are always elastically urged to a needle upper position by the compressed coil springs 135. When the needle bar cases 120 are moved in the right-left direction, the connecting pins 134 of the needle bars 121 facing the vertically movable members 127 are selectively engaged with the engaging grooves 127A of the corresponding vertically movable members 127.

Therefore, as the main shaft 117 is rotated by operation of a machine motor 177(shown in FIG. 9) in a predetermined rotational direction, the vertically movable members 127 and the needle bar holders 128 are together moved up and down through movement transmission by the eccentric levers 133, the oscillating levers 130 and the links 131. Thereby, only the needle bars 121 connected to the vertically movable members 127 by the connecting pins 132 are vertically reciprocated in accordance with rotation of the main shaft 117.

A needle bar jump mechanism 140, provided for each of the embroidering machine M1–M3 that causes the needle bars 121 to jump to a highest position (top dead center), will now be described with reference to FIG. 6.

Inside each needle bar case 120, a needle bar jumping solenoid 141 extends horizontally, and a pivoting lever 142, having a generally "L" shape in a plan view, is connected to the needle bar case 120 in such a manner that the pivoting lever 142 is pivotable around a vertical axis. A drive portion 142A of the pivoting lever 142 abuts on a plunger of the needle bar jumping solenoid 141. A driven portion 142B of the pivoting lever 142 is connected to a vertically extending operating shaft 143 which is engageable with an engaging portion 127B projected integrally from the vertically movable member 127.

Figure 6:
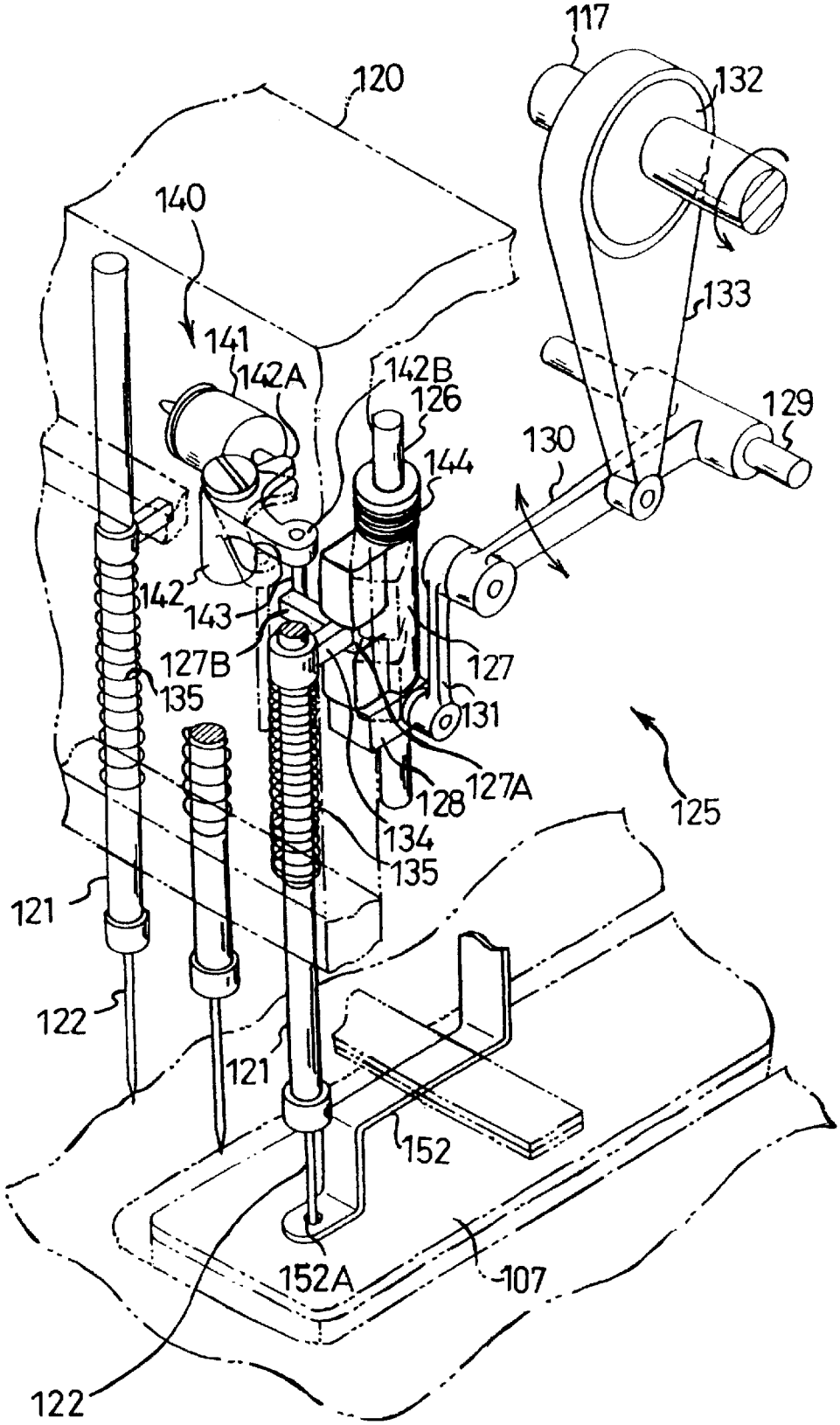
FIG. 6 is a schematic perspective view of a needle bar jump mechanism and a needle bar drive mechanism.

The vertically movable member 127 is always elastically urged by a helical spring 144, provided at an upper end of the vertically movable member 127, in such a manner that the vertically movable member 127 tends to pivot to a normal connected position indicated by a solid line in FIG. 6 from a jumped position (indicated by a two-dot line) to which the vertically movable member 127 is pivoted by the needle bar jumping solenoid 141.

If the needle bar jumping solenoid 141 is driven for a predetermined length of time to thrust the plunger to the right, in FIG. 6, when a needle bar 121 is connected to the vertically movable member 127 by the connecting pin 134, the pivoting lever 142 is turned clockwise in a top plan view so that the vertically movable member 127 is turned to the jumped position indicated by the two-dot line by the operating shaft 143 and the engaging portion 127B. The engagement between the engaging groove 127A and the connecting pin 134 is thereby undone. Simultaneously, the needle bar 121 is instantly moved (jumped) to the needle upper position by the compressed coil spring 135.

If the vertically movable member 127 is moved toward an approximately highest position from below when the vertically movable member 127 has been returned to the connected position and the needle bar 121 remains at the needle upper position, the vertically movable member 127 contacts the connecting pin 134 from below and temporarily turns to the jumped position. However, the helical spring 144 immediately turns the vertically movable member 127 back to the connected position, so that the engaging groove 127A of the vertically movable member 127 automatically engages with the connecting pin 134 of the needle bar 121.

A presser foot device 150, for switching the position of a presser foot 152 that presses a work cloth laid near the sewing needles 122 between an ascent position and a descent position, will be described with reference to FIG. 7.

A presser bar 151 extends vertically behind each base needle bar 126. The presser bar 151 is vertically movably supported at its upper and lower ends by a body frame 107. The lower end of the presser bar 151 is firmly connected to a rear end portion of the presser foot 152. The presser foot 152 is bent in a generally crank shape in a side view. A forward end portion of the presser foot 152 has a circular hole 152A through which the sewing needle 122 penetrates.

Figure 7:
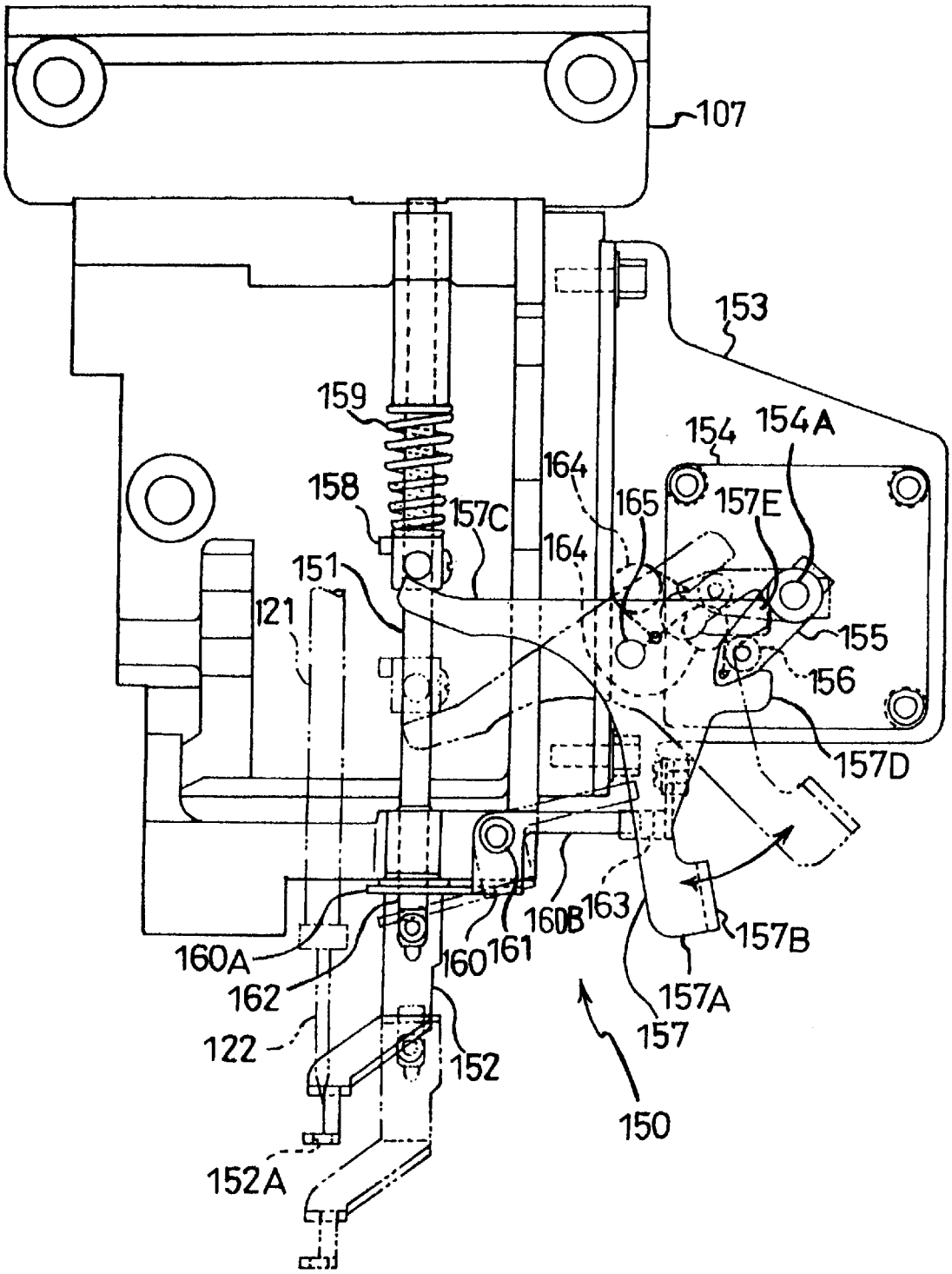
FIG. 7 is a front elevation of a third preferred embodiment of the presser foot device of the invention.

A support plate 153 is fixed to the body frame 107 and extends therefrom to the right in FIG. 7. A presser foot motor 154 which is a two-phase stepping motor is fixed to the support plate 153.

The presser foot motor 154 is magnetized in a one-two phase magnetization method by a control device 170 described below, at a rate of one rotation for about 400 pulses. That is, the presser foot motor 154 is magnetized in a magnetizing sequence in which one-phase magnetization and two-phase magnetization alternate as in (A), (A, B), (B), (B, A-), . . . (B-), (B-, A).

A drive shaft 154A of the presser foot motor 154 is firmly connected to a base end of a drive arm 155 whose distal end is provided with a small bearing 156.

An operating lever 157, shaped in a generally inverted "L" in a front view, is disposed between the presser foot motor 154 and the presser bar 151. The operating lever 157 is pivotably supported at an approximately central portion thereof by a pivot pin 165 fixed to the support plate 153. That is, the presser foot 152 is operatively connected to the presser foot motor 154.

A downward extending first arm portion 157A of the operating lever 157 has an operating portion 157B that is bent rearward. A leftward extending second arm portion 157C of the operating lever 157 contacts, from below, an engaging member 158 connected to the presser bar 151. The bearing 156 of the drive arm 155 is slidably fitted between a first protrusion 157D and a second protrusion 157E of the operating lever 157 that protrude in a fork shape. When the drive arm 155 is turned to a first pivot position indicated by a solid line by forward, or counterclockwise, rotation from the presser foot motor 154, the operating lever 157 is turned to an operating position indicated by a solid line by engagement between the bearing 156 and the first protrusion 157D so that the presser bar 151 is raised by the engaging member 158 to an ascent position indicated by a solid line.

Conversely, when the drive arm 155 is turned to a second pivot position indicated by a two-dot line, the operating lever 157 is turned to an escape position indicated by a two-dot line, so that the presser bar 151 descends to a descent position while the engaging member 158 remains engaged with the operating lever 157. As the compressed coil spring 159 is disposed between the engaging member 158 and the body frame 107, the presser bar 151 is always urged downward by spring force of the compressed coil spring 159 and, therefore, reliably lowered to the descent position.

An operating lever 160 having a generally crank shape, in a side view, is pivotably supported by a screw 161 to a portion of the body frame 107 immediately rightward from the presser bar 151. A drive portion 160A of the operating lever 160 extends leftward for abutment on an engaging member 162 from above. The engaging member 162 is fixed to a lower end portion of the presser bar 151.

Figure 8:
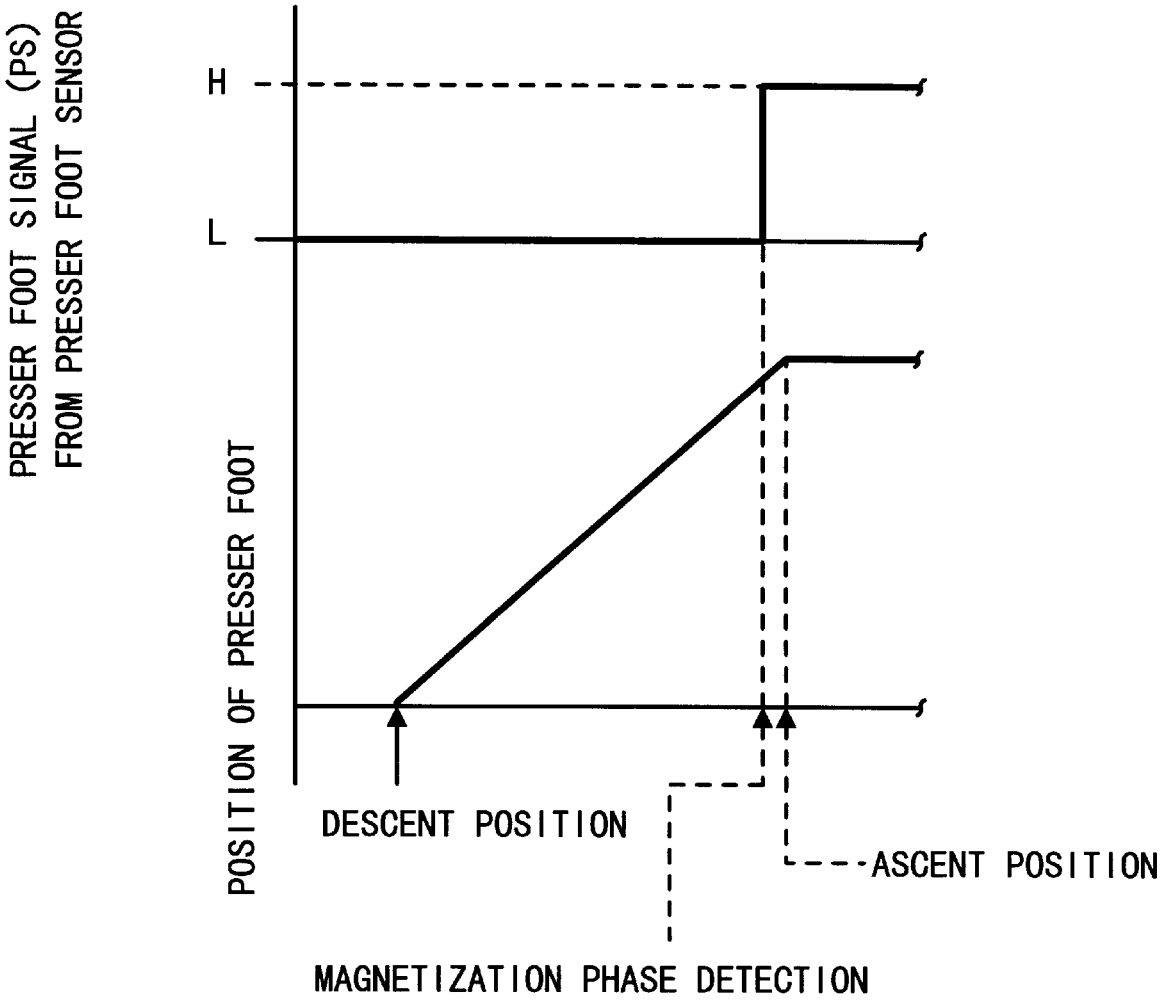
FIG. 8 is a diagram illustrating a presser foot signal relative to the position of the presser foot between descent and ascent positions.

An operating portion 160B of the operating lever 160 extends rightward. A distal end of the operating portion 160B blocks a presser foot optical sensor 163 connected to a lower end portion of the support plate 153. The presser foot optical sensor 163 is formed of a photo-interrupter. The operation of the presser foot optical sensor 163 will be described in detail with reference to FIGS. 7 and 8. When the presser foot 152 is at the descent position, the presser foot optical sensor 163 outputs a presser foot signal PS (corresponding to a detection signal) at a LOW level. When the presser foot 152 is raised from the descent position to the ascent position as a result of an upward movement of the presser bar 151 achieved by forward rotation from the presser foot motor 154 transmitted by the operating lever 157 and the engaging member 158, the operating lever 160 is turned by the engaging member 162 so that the operating portion 160B of the operating lever 160 blocks light emitted from an light-emitting element of the presser foot optical sensor 163. Thereby the presser foot optical sensor 163 outputs the presser foot signal PS at a HIGH level. The operating lever 160, the presser foot optical sensor 163 and the like constitute a detection device.

A coiled spring 164 is connected between the distal end of the drive arm 155 and the operating lever 157. Therefore, when the operating lever 157 is at the operating position, the first protrusion 157D is pressed against the bearing 156 by the elastic force of the coiled spring 164. When the operating lever 157 is at the escape position, the second protrusion 157E is pressed against the bearing 156. Thus, the coiled spring 164 prevents impact noises from being produced by impact of the first or second protrusion 157D, 157E against the bearing 156 even when the operating lever 157 vibrates during stitching operations of the embroidering machines M1–M3.

During stitching operations, the presser foot 152 is moved up and down at a predetermined timing, in accordance with the timing of rotation of the main shaft 117, by a presser foot vertically driving mechanism (not shown).

A control system of the multi-head embroidering machine M will now be briefly described with reference to the block diagram of FIG. 9.

A control device 170 for controlling the entire embroidering machine M is formed of a microcomputer having a CPU 171, a ROM 172 and a RAM 173, and an input interface (not shown) and an output interface (not shown) that are connected to the microcomputer by buses, such as a data bus and the like.

The control device 170 is connected, in relation to the embroidering machine M1, to a drive circuit 175 for the needle bar jumping solenoid 141, a drive circuit 176 for the presser foot motor 154, and the presser foot optical sensor 163. With regard to the other embroidering machines M2, M3, substantially the same connections are made from the control device 170. The control device 170 is also connected to a drive circuit 178 for driving the machine motor 177, a drive circuit 180 for the needle bar replacing motor 179 for moving the needle bar cases 120, a drive circuit 182 for the X-axis driving motor 181, a drive circuit 184 for the Y-axis driving motor 183, and the operating panel 118.

Routines of presser foot ascent/descent control executed by the control device 170 will be described with reference to the flowcharts of FIGS. 10–13. A control program of the presser foot ascent/descent control is pre-stored in the ROM 172. In FIGS. 10–13, reference characters Si (i=10, 11, 12 . . . ) indicate steps in the routines.

Figure 10:
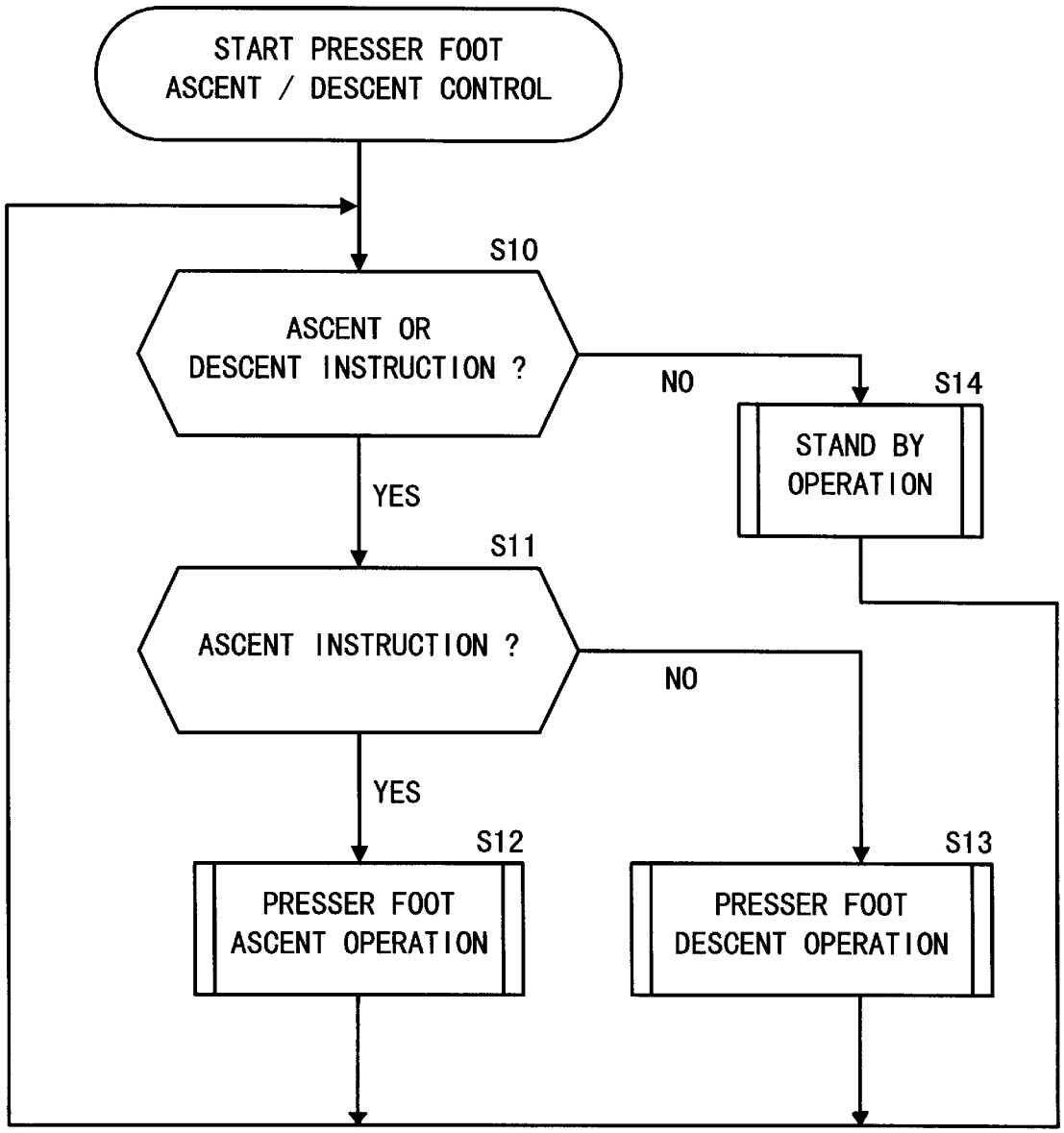
FIG. 10 is a flowchart of a presser foot operation control routine.

Referring to FIG. 10, when the multi-head embroidering machine M is powered on, the control is started. When power is supplied, or when an ascent or descent instruction to move the presser foot 152 is outputted due to a need therefor (YES in step S10), and a YES occurs in step S11 in which it is determined the instruction is an ascent instruction, a presser foot ascent operation control routine (FIG. 11) is performed in step S12.

Figure 11:
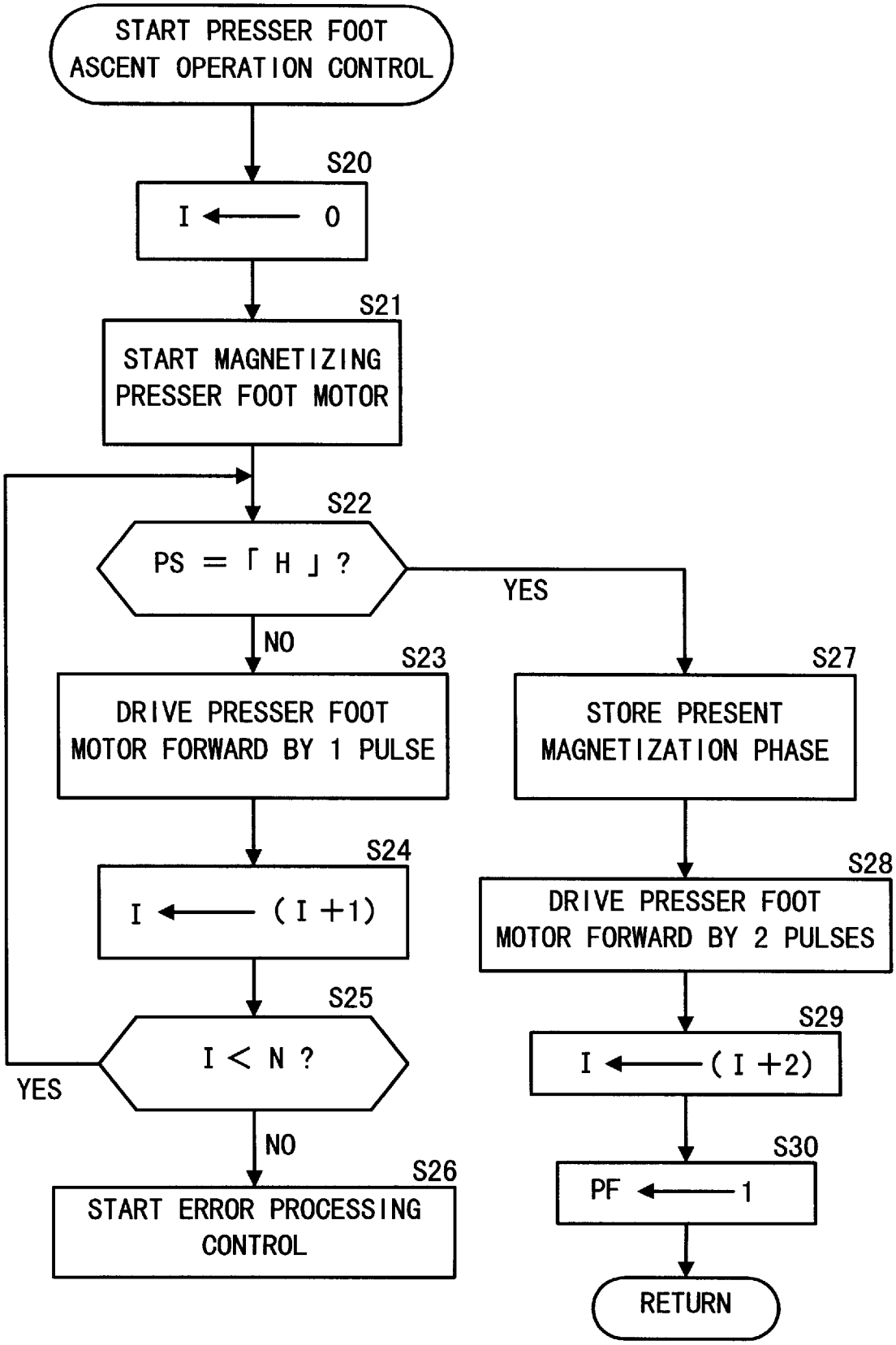
FIG. 11 is a flowchart of a presser foot ascent operation control routine.

When the presser foot ascent operation control routine is started, the count value I of a pulse counter is cleared in step S20, and then magnetization of the presser foot motor 154 is started in step S21 as shown in FIG. 11. In step S22, it is determined whether the presser foot signal PS inputted from the presser foot optical sensor 163 is at the HIGH level. If the presser foot signal PS is at the LOW level (NO in step S22), which indicates that the presser foot 152 is at the descent position, the presser foot motor 154 is driven forward by one pulse in step S23. Subsequently in step S24, the count value I is incremented by 1. In step S25, it is determined whether the incremented count value I is less than a number N of drive pulses corresponding to the pivot limit position of the operating lever 157. If the count value I is less than the number N (YES in step S25), the operation in steps S22–S25 is repeated, so that the presser bar 151 is raised through transmission by the drive arm 155 and the operating lever 157.

When the presser foot 152 reaches the ascent position, so that the presser foot signal PS switches to the HIGH level (YES in step S22), a present magnetization phase of the presser foot motor 154 at the time of switch of the presser foot signal PS to the HIGH level, for example, an (A, B) magnetization phase, is detected. In step S27, the magnetization phase is stored as a detected magnetization phase into a work memory of the RAM 173. That is, every time the presser foot 152 is raised by the presser foot motor 154 in response to an ascent instruction, the detected magnetization phase of the presser foot motor 154 is detected and stored and thereby updated. Therefore, a detected magnetization phase optimal to the ascent position of the presser foot 152 can be stored even in a case where the detected magnetization phase deviates due to mechanical abrasion in the presser foot device 150.

Subsequently in step S28, the presser foot motor 154 is further driven forward by two pulses, and maintained in the state of the magnetization phase which is brought about by the extra two pulses. In step S29, the count value I is incremented by 2. In step S30, value "1", indicating the ascent position, is set as a flag data of a presser foot flag PF. Then, the control routine ends and the operation returns to step S10 of the presser foot ascent/descent control. The aforementioned driving of the presser foot motor 154 by extra two pulses in step S28 prevents the presser foot signal PS from switching to the LOW level by accident, for example, due to vibrations of the operating lever 160 during stitching operations.

If a descent instruction to lower the presser foot 152 is outputted, for example, for the start of stitching, (YES in step S10 and NO in step S11), a presser foot descent operation control routine (FIG. 12) is performed in step S13.

Figure 12:
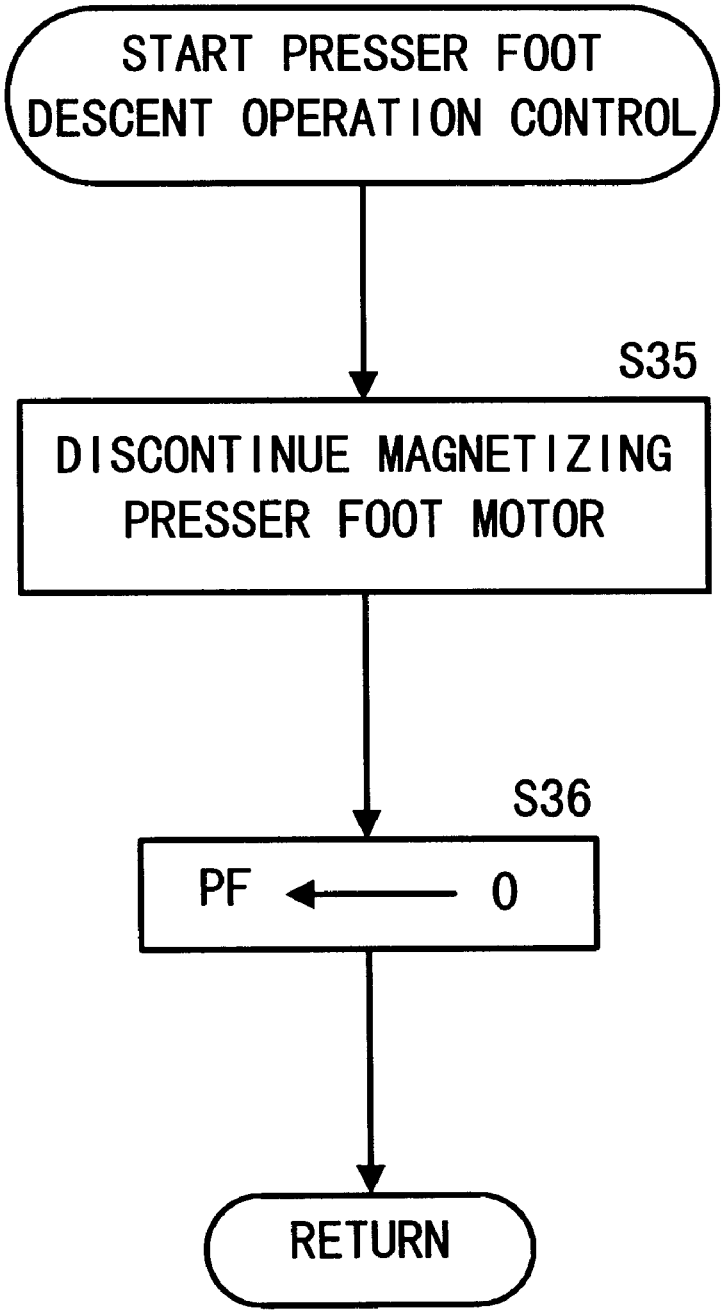
FIG. 12 is a flowchart of a presser foot descent operation control routine.
Figure 13:
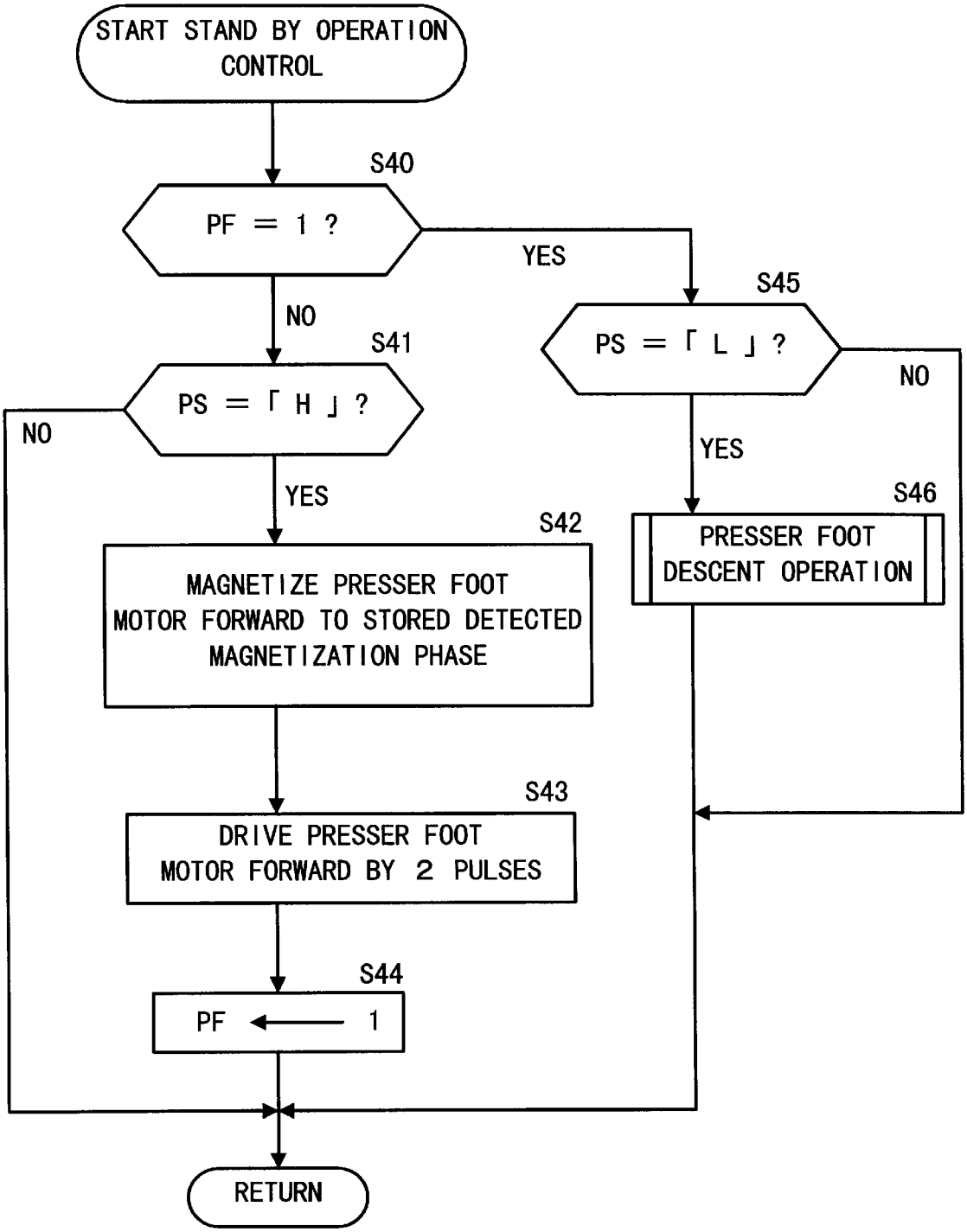
FIG. 13 is a flowchart of a standby operation control routine.

When the presser foot descent operation control routine is started, magnetization of the presser foot motor 154 is discontinued in step S35 in FIG. 12. After value "0", indicating the descent position, is set in step S36, this control routine ends and the operation returns to step S10.

That is, when the presser foot 152 is to be lowered from the ascent position in response to a descent instruction, magnetization of the presser foot motor 154 is discontinued. The discontinuation of magnetization is maintained while the presser foot 152 remains at the descent position. Therefore, since magnetization of the presser foot motor 154 is discontinued, the presser foot 152 can be lowered to the descent position by the spring force of the compressed coil spring 159. Since the discontinuation of magnetization of the presser foot motor 154 is maintained while the presser foot 152 remains at the descent position after the presser foot 152 is allowed to descend by discontinuation of magnetization of the presser foot motor 154, it is possible to move the presser foot 152 up and down using the presser foot up-down driving mechanism synchronously with the machine motor 177 during stitching operations.

If neither the descent instruction or the ascent instruction is outputted in the presser foot ascent/descent control (NO in step S10), a standby operation control routine (FIG. 13) is executed in step S14.

When the standby operation control routine is started, it is determined in step S40 whether the presser foot flag PF has been set to "1". If the presser foot flag PF is not set, that is, has been reset (NO in step S40), the descent position of the presser foot 152 is indicated. In step S41, it is determined whether the presser foot signal PS is at the HIGH level. If the presser foot signal PS is at the LOW level (NO in step S41) indicating that the presser foot 152 is at the descent position, this control routine ends and the operation returns to step S10. In short, while the presser foot 152 remains at the descent position, the discontinuation of magnetization is maintained.

If the presser foot flag PF has been set to "1", indicating the ascent position of the presser foot 152 (YES in step S40), it is determined in step S45 whether the presser foot signal PS is at the LOW level. If the presser foot signal PS is at the HIGH level indicating that the presser foot 152 is at the ascent position (NO in step S45), this control routine ends and the operation returns to step S10. In short, while the presser foot 152 is at the ascent position, magnetization is maintained in the present magnetization phase.

If the presser foot flag PF has been set to "1" indicating that the presser foot 152 is at the ascent position (YES in step S40), the presser foot 152 may be lowered by manually pressing the operating portion 157B of the operating lever 157 upward so that an area trace operation for moving the movable frame 116 along an embroidery area is started in order to confirm the embroidery area before the stitching. In such a case, the presser foot motor 154 can be rotated to an extent which does not cause a step out of timing.

A slight pivot of the operating lever 157 causes the presser bar 151 to slightly descend, so that the presser foot optical sensor 163 outputs the presser foot signal PS at the LOW level in response to the corresponding pivot of the operating lever 160 (YES in step S45). Subsequently in step S46, the presser foot descent operation control routine illustrated in FIG. 12 is executed. Then, this control routine ends and the operation returns to step S10. That is, because magnetization of the presser foot motor 154 is discontinued when the presser foot 152 is lowered from the ascent position by manually operating the operating lever 157, and because the discontinuation of magnetization is maintained while the presser foot 152 remains at the descent position, the presser foot 152 can be lowered to the descent position by the elastic force of the compressed coil spring 159.

When the presser foot flag PF has been reset and the presser foot 152 is at the descent position (NO in step S40), the presser foot 152 may be raised by manually pushing the operating portion 157B of the operating lever 157 downward. Since magnetization of the presser foot motor 154 has been discontinued, the operating lever 157 can easily be pushed, so that the presser foot 152 is raised to the ascent position through transmission by the presser bar 151. Then, the presser foot optical sensor 163 switches to output the presser foot signal PS at the HIGH level (YES in step S41). As a result, in step S42, the presser foot motor 154 is magnetized in the detected magnetization phase stored in step S27. In step S43, the presser foot motor 154 is further driven forward by two pulses, and maintained in the state of the magnetization phase that is brought about by the two extra pulses. Subsequently in step S44, the presser foot flag PF is set. Then this control routine ends and the operation returns to step S10.

That is, when the presser foot 152 is raised from the descent position by manually operating the operating lever 157, the presser foot motor 154 is additionally driven by two pulses after the magnetization phase that is first detected following detection of the HIGH level-switched presser foot signal PS from the presser foot optical sensor 163, and is maintained in the two-pulse-advanced magnetization phase. That is, when the presser foot 152 stops at the ascent position, the magnetization phase of the presser foot motor 154 is determined as in a case where the presser foot 152 is automatically raised in response to an ascent instruction. Therefore, when the presser foot 152 is manually raised and stopped at the ascent position, an approximately ½ step rotation of the presser foot motor 154 in forward or backward direction is prevented and, therefore, no disagreeable operating feeling is given to an operator's hand, thereby improving operating feeling. The aforementioned two-pulse-advanced magnetization phase is a magnetization phase that is finally obtained by advancing the magnetization phase from the stored magnetization phase by a number of phases corresponding to two pulses.

Figure 14:
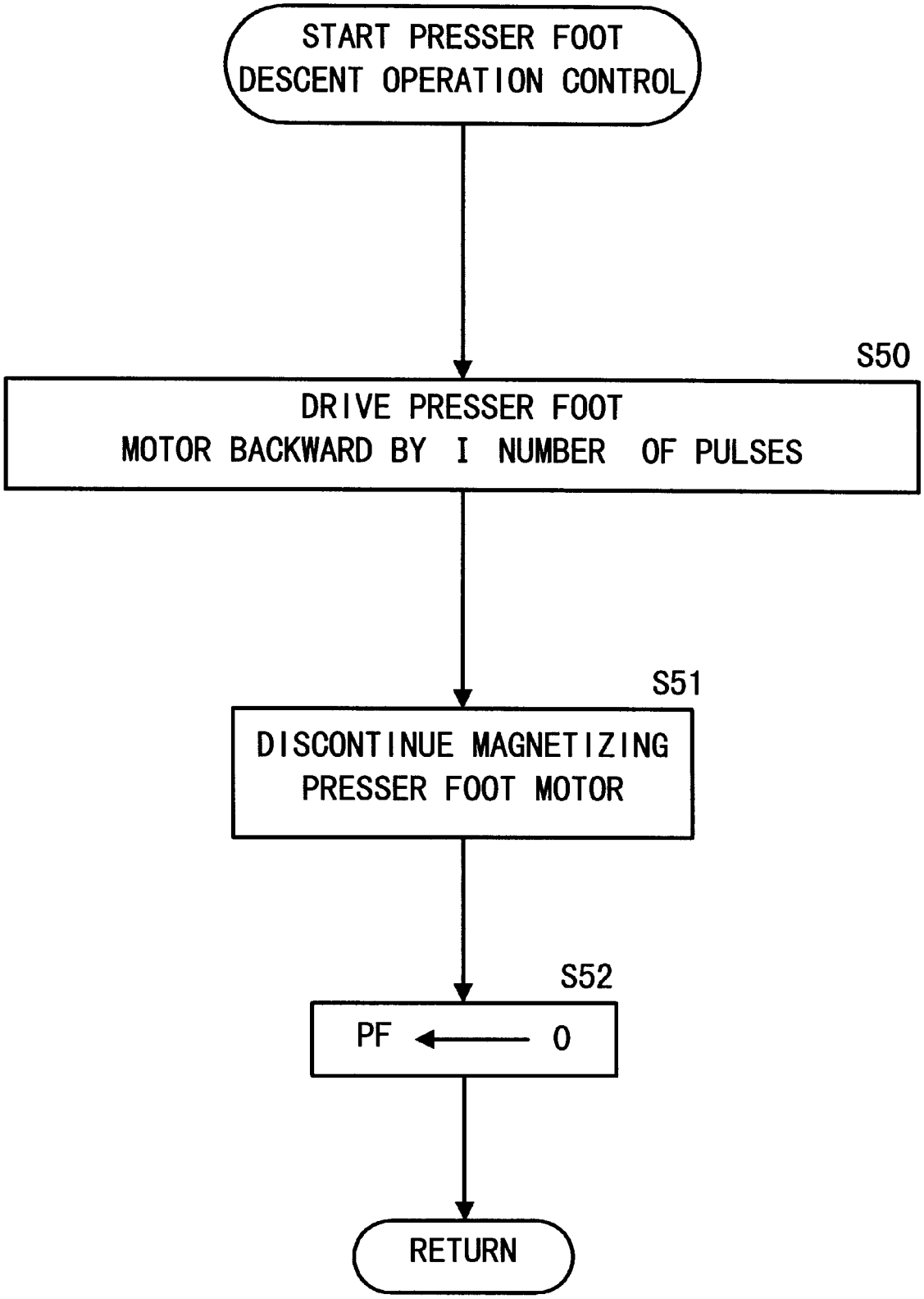
FIG. 14 is a flowchart of a presser foot descent operation control routine according to a modification.

In a modification of the foregoing embodiment, the presser foot descent operation control routine illustrated in FIG. 12 may be partially changed as illustrated in FIG. 14. That is, to lower the presser foot 152, the presser foot motor 154 is reversely driven by the I number of pluses used for the ascent of the presser foot 152, in step S50. Then, as in steps S35 and S36, magnetization of the presser foot motor 154 is discontinued in step S51, and the presser foot flag PF is reset in step S52. This modification makes it possible to smoothly and quietly lower the presser foot 152 to the descent position. In addition, the forward driving by two pulses in steps S28 in the presser foot ascent operation control routine shown in FIG. 11 and in step S43 of the standby operation control routine shown in FIG. 13 may be omitted.

It is also possible to omit the operating lever 160 and, instead, construct a presser foot device such that the presser foot optical sensor 163 outputs a presser foot signal PS at the HIGH level when the operating lever 157 is turned to the operating position. The foregoing embodiments can be modified on the basis of technologies known to those skilled in the art. It is also possible to apply the invention to various pattern stitching or sewing machines for stitching various patterns.

It is to be understood that the invention is not restricted to the particular forms shown in the foregoing embodiments. Various modifications and alternations can be made thereto without departing from the scope of the invention encompassed by the appended claims.

What is claimed is:

1. A presser foot device of a sewing machine, comprising:

a presser foot vertically movably supported to a sewing machine body frame by a presser bar;

a drive device, having a rotating shaft, that moves the presser bar up and down in accordance with a drive signal;

a detection device that detects an ascent of the presser foot to a predetermined position by detection of an angle of rotation of the rotating shaft of the drive device; and a control device that controls the drive signal on the basis of result of the detection made by the detection device.

2. The presser foot device of a sewing machine according to claim 1, wherein the drive device comprises a stepping motor.

3. A presser foot device of a sewing machine, comprising:

a presser foot vertically movably supported to a sewing machine body frame by a presser bar;

a drive device that moves the presser bar up and down in accordance with a drive signal;

a detection device that detects an ascent of the presser foot to a predetermined position; and a control device that controls the drive signal on the basis of result of the detection made by the detection device, wherein the detection device is provided near the presser foot and directly detects the rise of the pressure foot.

4. A presser foot device of a sewing machine, comprising:

a presser foot that presses a work cloth against a bed;

a drive device that continually moves the presser foot up and down in accordance with a drive signal using a drive force transmitting mechanism;

an operating lever that abuts on a portion of the presser foot and moves in accordance with vertical movements of the presser foot; and a detection device that detects an ascent of the presser foot to a predetermined position on the basis of a shift of the operating lever in position.

5. The presser foot device of a sewing machine according to claim 4, wherein the drive device comprises a stepping motor, and wherein a control device is further provided for controlling the stepping motor on the basis of a result of the detection made by the detection device.

6. The presser foot device of a sewing machine according to claim 4, wherein the operating lever separates from the presser foot during descent of the presser foot, and abuts on a portion of the presser foot when the presser foot is raised close to the predetermined position.

7. The presser foot device of a sewing machine according to claim 4, further comprising a spring member that engages with and urges the drive force transmitting mechanism to restrict the turning of the drive force transmitting mechanism.

8. A presser foot device of a sewing machine, comprising:

a presser foot vertically movably supported to a sewing machine body frame by a presser bar;

an operating lever for switching the presser foot between an ascent position and a descent position;

a spring member that urges the presser foot in the descending direction;

a detection device that detects a presence of the presser foot at the ascent position using one of the presser foot and the operating lever;

a stepping motor operatively connected to the presser foot, the stepping motor being capable of at least driving the presser foot upward; and a control device that receives a detection signal from the detection device and controls the stepping motor so as to allow the presser foot to be lowered by manually operating the operating lever.

9. The presser foot device of a sewing machine according to claim 8, wherein the control device controls the stepping motor so as to also allow the presser foot to be raised through manually operating the operating lever.

10. The presser foot device of a sewing machine according to claim 8, wherein the stepping motor is operatively connected to the presser foot by the operating lever.

11. The presser foot device of a sewing machine according to claim 8, further comprising a spring member that presses and urges the operating lever in accordance with an operation position of the operating lever.

12. The presser foot device of a sewing machine according to claim 9, wherein when the control device raises the presser foot from the descent position by operating the stepping motor in response to an ascent instruction, the control device detects a magnetization phase of the stepping motor at the time of detection of the ascent position of the presser foot by the detection device, and stores the magnetization phase into a memory as a detected magnetization phase.

13. The presser foot device of a sewing machine according to claim 12, wherein when the presser foot is at the ascent position, the control device keeps the stepping motor in a magnetized state in which the stepping motor is in a predetermined magnetization phase that is advanced from the detected magnetization phase by a predetermined number of steps.

14. The presser foot device of a sewing machine according to claim 8, wherein when the operating lever is manually operated to lower the presser foot from the ascent position, the control device discontinues magnetizing the stepping motor so as to allow the presser foot to descend, and the control device maintains the discontinuation of magnetization while the presser foot remains at the descent position.

15. The presser foot device of a sewing machine according to claim 13, wherein when the presser foot is raised from the descent position by manually operating the operating lever, the control device magnetizes and keeps the stepping motor in the predetermined magnetization phase that is first detected after the ascent position of the presser foot is detected by the detection device.

16. The presser foot device of a sewing machine according to claim 8, wherein when the control device lowers the presser foot from the ascent position in response to a descent instruction, the control device discontinues magnetizing the stepping motor, and the control device maintains the discontinuation of magnetization while the presser foot remains at the descent position.

17. The presser foot device of a sewing machine according to claim 13, wherein when the control device raises the presser foot from the descent position in response to an ascent instruction, the control device magnetizes and keeps the stepping motor in the predetermined magnetization phase that is first detected after the ascent position of the presser foot is detected by the detection device.

18. The presser foot device of a sewing machine according to claim 8, wherein the control device controls the stepping motor to raise and lower the presser foot, in accordance with ascent and descent instructions from an external device.

19. A presser foot device used with a sewing element of a sewing apparatus, the sewing element including a frame and at least one needlebar, the presser foot device comprising:

a presser bar mounted to the frame for reciprocal movement;

a presser foot mounted to an end of the presser bar;

a drive motor for reciprocatively moving the presser bar;

a link pivotally mounted to the frame having a first end operatively engaged with the drive motor and a second end operatively engaged with the presser bar;

a detector operatively engaged with one of the drive motor and the presser foot that detects the presser foot at a predetermined position; and a controller that controls the drive motor on the basis of the detection made by the detector.

20. The presser foot device according to claim 19, further comprising a force application member applying a force to move the presser bar in a direction in which the presser foot contacts an object to be sewn.

21. The presser foot device according to claim 20, further comprising an engaging member mounted to the presser bar, the force application member engaging one side of the engaging member and the second end of the link operatively engaged with the other side of the engaging member.

22. The presser foot device according to claim 20, wherein the operative engagement between the drive motor and the link comprises a rotating shaft with a lever attached thereto;

a bearing positioned apart from the rotating shaft and extending from the lever; and the first end of the link having a cutout portion for receiving the bearing.

23. The presser foot device according to claim 19, wherein the detector comprises:

an operating lever pivotally mounted to the frame and having a first arm extending in a first direction and a second arm extending in an opposite direction, the first and second arms parallel but offset from one another; and a sensor element mounted to the frame for detecting an end of the second arm, wherein an upper portion of the presser foot contacts the first arm during movement away from a sewing surface.

24. The presser foot device according to claim 22, wherein the lever has a second extended end; and further comprising a sensor device mounted to the frame for detecting the second extended end.

25. The presser foot device according to claim 23, wherein the sensor device is one of a photoelectric sensor and an electromagnetic sensor.

26. The pressure foot device according to claim 22, further comprising a tensioning device that restricts excessive oscillation of the lever.

27. The presser foot device of a sewing machine according to claim 19, wherein when the controller raises the presser foot from the descent position by operating the drive motor in response to an ascent instruction, the controller detects a magnetization phase of the drive motor at the time of detection of the ascent position of the presser foot by the detector, and stores the magnetization phase into a memory as a detected magnetization phase.

28. The presser foot device of a sewing machine according to claim 27, wherein when the presser foot is at the ascent position, the controller keeps the drive motor in a magnetized state in which the drive motor is in a predetermined magnetization phase that is advanced from the detected magnetization phase by a predetermined number of steps.

29. The presser foot device according to claim 19, wherein the link further includes an operating portion for manual positioning of the presser foot.

30. The presser foot device of a sewing machine according to claim 22, wherein when the link is manually operated to lower the presser foot from the ascent position, the controller discontinues magnetizing the drive motor so as to allow the presser foot to descend, and the controller maintains the discontinuation of magnetization while the presser foot remains at the descent position.

31. The presser foot device of a sewing machine according to claim 22, wherein when the presser foot is raised from the descent position by manually operating the link, the controller magnetizes and keeps the drive motor in the predetermined magnetization phase that is first detected after the ascent position of the presser foot is detected by the detection device.

* * * * *